United States Patent [19]

McCullough

[11] 3,995,578

[45] Dec. 7, 1976

[54] SCUBA DIVERS PROPULSION UNIT

[76] Inventor: Keith R. McCullough, 5336 Camelot Drive SW., Olympia, Wash. 98502

[22] Filed: Oct. 3, 1975

[21] Appl. No.: 610,138

[52] U.S. Cl. ..... 115/6.1; 114/16 A

[51] Int. Cl.[2] ..... B63B 21/00

[58] Field of Search ..... 115/6.1; 114/16 A; 9/301; 61/69 R

[56] References Cited

UNITED STATES PATENTS

| | | | |
|---|---|---|---|
| 2,722,021 | 11/1955 | Keogh-Dwyer | 114/16 A |
| 3,014,448 | 12/1961 | Fogarty et al. | 115/6.1 X |
| 3,329,118 | 7/1967 | Strader | 114/16 A |
| 3,916,814 | 11/1975 | Bardoni et al. | 115/6.1 |

*Primary Examiner*—Trygve M. Blix
*Assistant Examiner*—Sherman Basinger

[57] ABSTRACT

A battery operated propulsion unit secured to a SCUBA divers air tank consisting of three chambers; the center one containing the propeller drive motor. On each side of the motor is one battery chamber which contains the batteries that supply the power for the propeller drive motor. The propeller is surrounded by a propeller housing. Wired in series with the motor and power supply batteries is the motor control. Wired in parallel or in series depending on the position of the switch and in series with the motor control and motor is a speed control switch.

1 Claim, 7 Drawing Figures

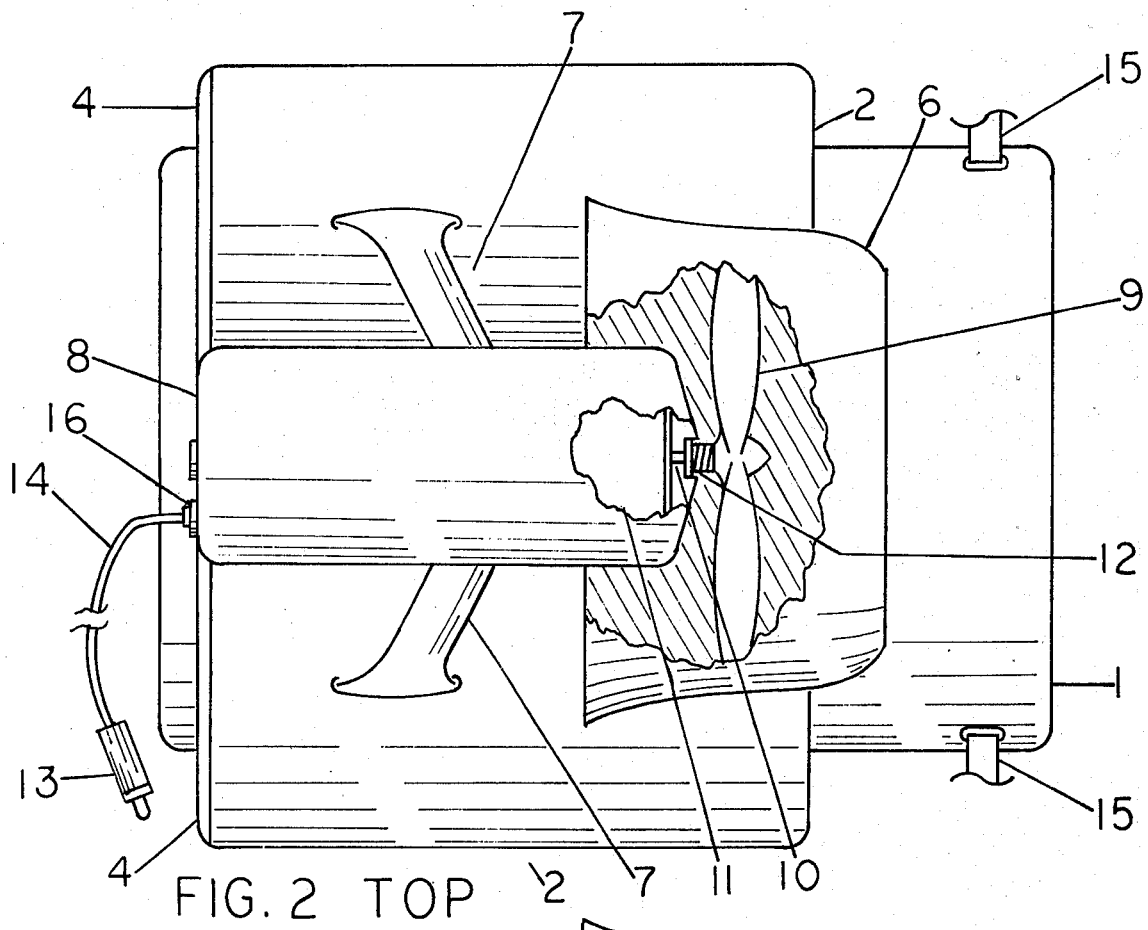
FIG. 2 TOP
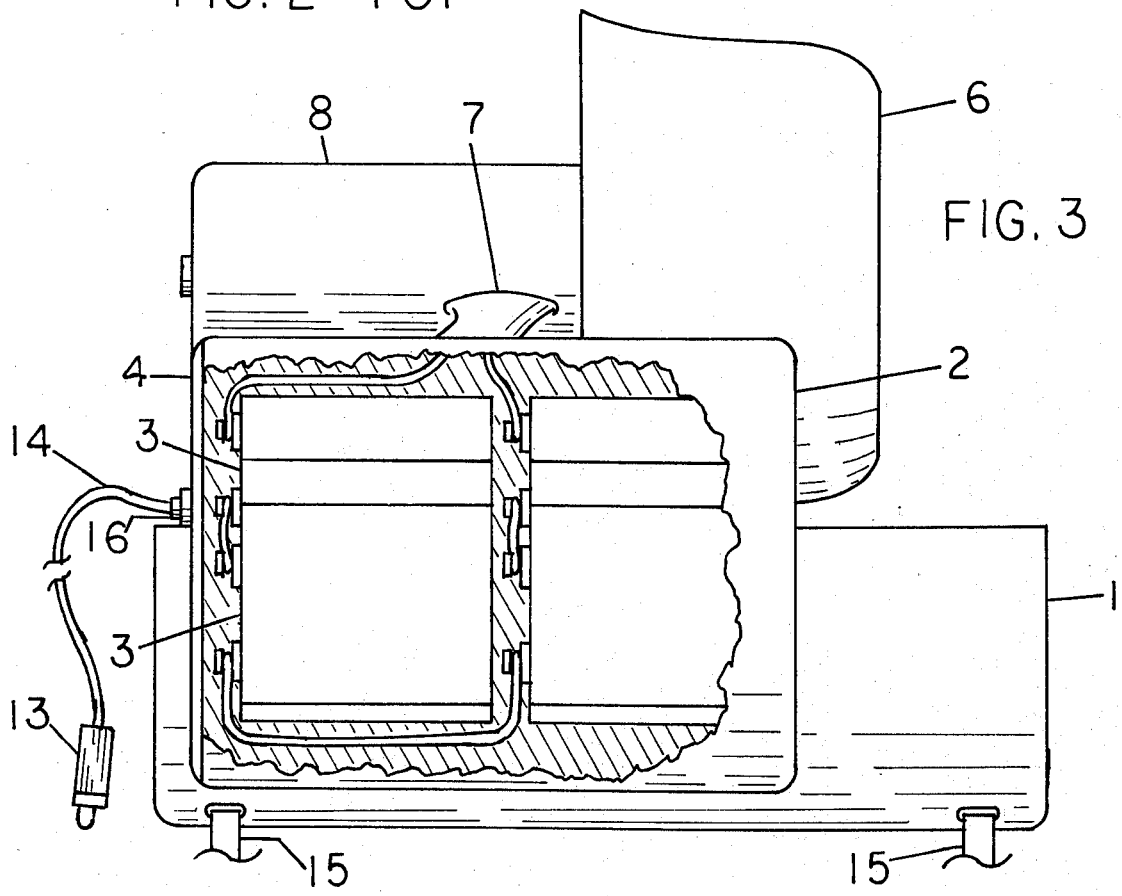
FIG. 3

SCUBA DIVERS PROPULSION UNIT

This unit has several important advantages over other units on the market, as listed:

1. It leaves your hands free to operate a camera, spear gun or other equipment.
2. It is always with you. You need not set it aside any time you stop and occupy your hands with other things, and you don't have to go back and look for it when you are ready to go.
3. You have no prop wash in front of you as with other models.

In production variations of this unit will use a more powerful motor for more thrust and speed. The power will possibly be supplied by silver-zink batteries as they have more amper hour capacity for a given size than do the lead-acid battery, unless a nichel-cadmium battery can be made with sufficient capacity in a compact enough size. The tank mounts will vary to fit the different air tanks on the market. The control may be a variable speed type. The motor shaft may have a spring loaded carbon to porcelain seal to prevent water entering the motor at greater depths. These variations will not change the arrangement of the componant parts, but are variations of the parts in the same positions as shown on the diagram.

This invention relates to a SCUBA divers propulsion unit that is strapped to a divers air tank which is in turn strapped to the divers back. This unit is simple in design, assembly, and operation. This unit is different in design from U.S. Pat. No. 3,014,448 issued Dec. 26, 1961 by W. J. Fogarty Etal in that it is strapped to the divers air tank rather than to the divers back with the divers air tank strapped to the diver. This unit is also different in that it uses a D.C. motor rather than an A.C. motor thus eliminating a D.C. -A.C. -D.C. converter. This unit is therefore much more compact and simple in design.

This unit is different in design from U.S. Pat. No. 3,329,118 issued July 4, 1967 by J. G. Strader in that it is strapped to the air tank with the air tank in turn strapped to the divers back rather than having the air tank inserted in a chamber of the unit. This unit is also different in that it uses only one motor rather than two motors thus simplifying the design and assembly.

This unit is different in design from U.S. Pat. No. 2,722,021 issued Nov. 1, 1955 by Keogh - Dwyer in that it is strapped to the divers air tank rather than to the stomach of the diver. This unit is designed for use with SCUBA diving equipment rather than for surface diving and swimming.

Because of the simplicity in design and assembly of this unit it could be manufactured and marketed with less expense than the aforementioned units.

The accompanying drawings are intended to illustrate the design of the unit and arrangement of the componant parts of the unit.

FIG. 2 is a top view of the unit with a portion of the propeller housing cut away to show the motor housing and propeller in position, and with a portion of the motor housing cut away to show the motor and motor shaft seal in position.

FIG. 3 is a side view of the unit with a portion of the power supply housing cut away to show the power supply in position.

Figure 1:
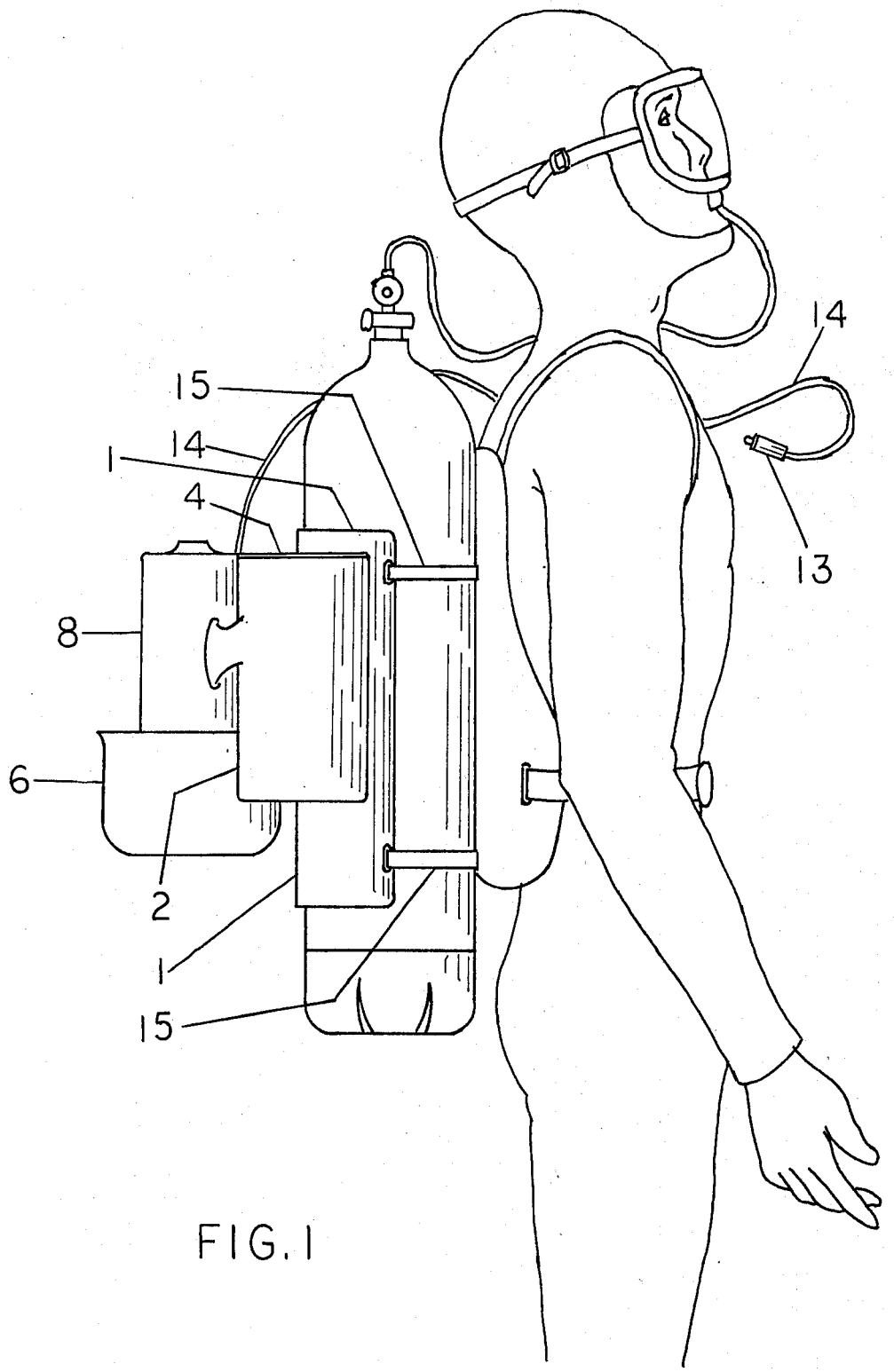
FIG. 1 shows the method of mounting the unit to the divers air tank which is strapped to the divers back.
Figure 4:
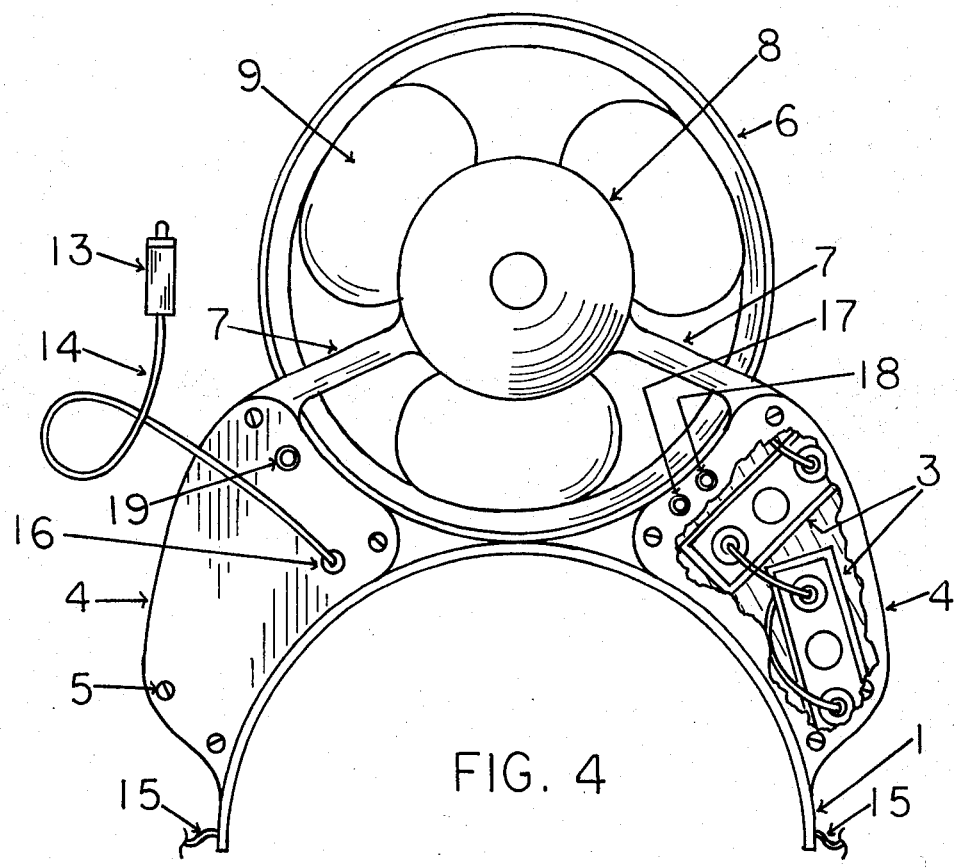
FIG. 4 is a front view of the unit with a portion of the power supply housing end cap cut away to show the power supply in position.
Figure 5:
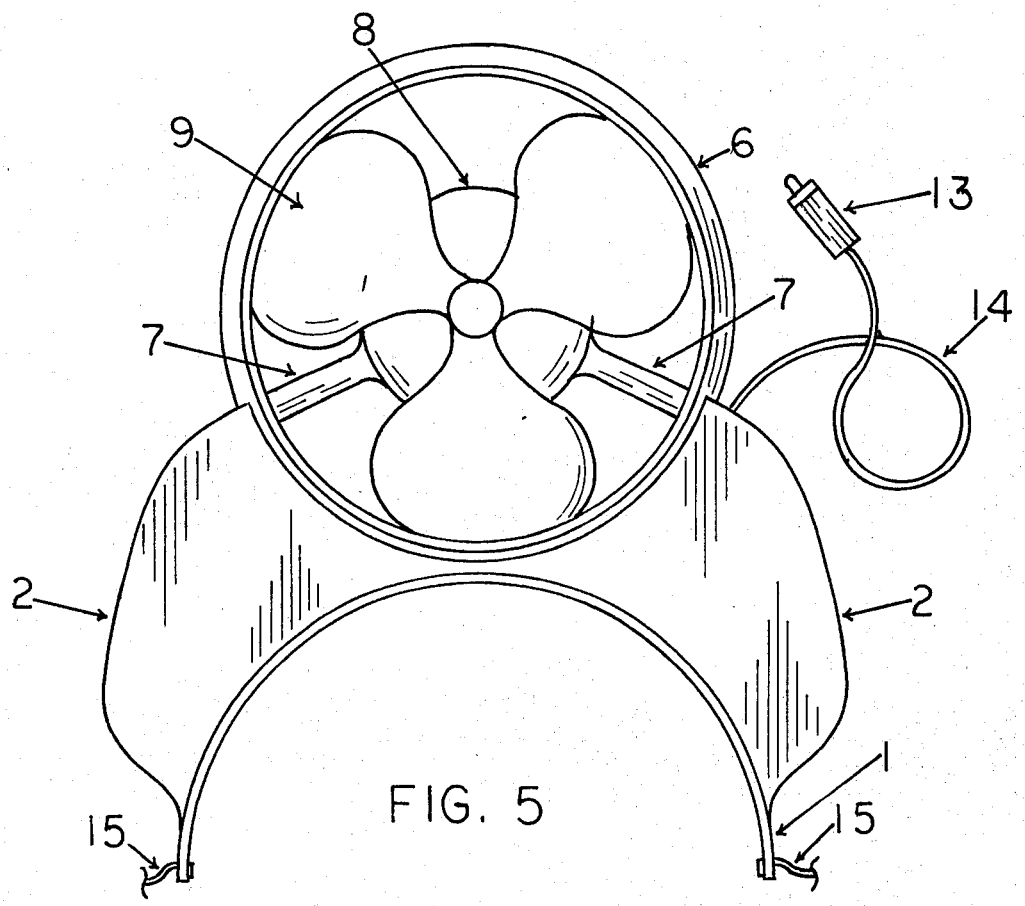
FIG. 5 is a back view of the unit.
Figure 7:
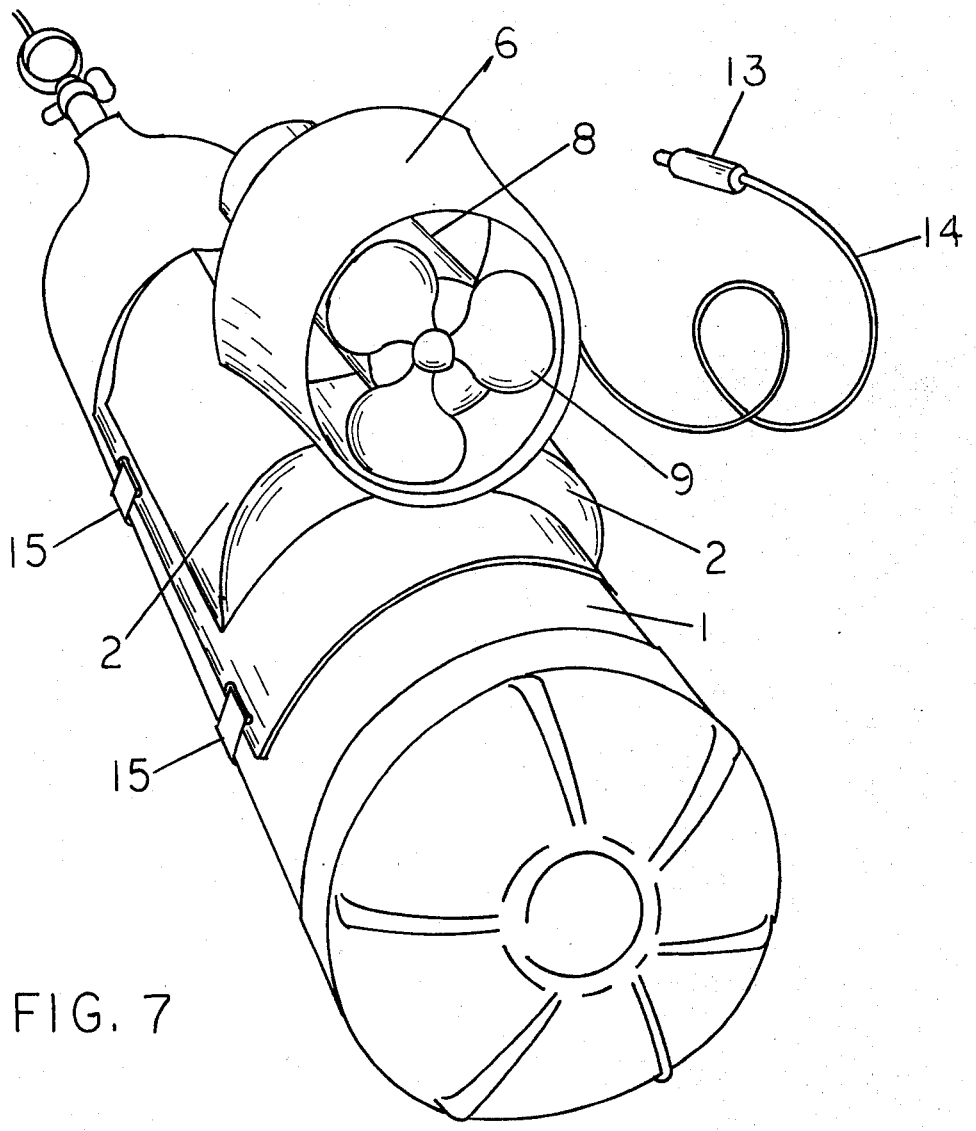
FIG. 7 shows a perspective view of the unit.
Figure 6:
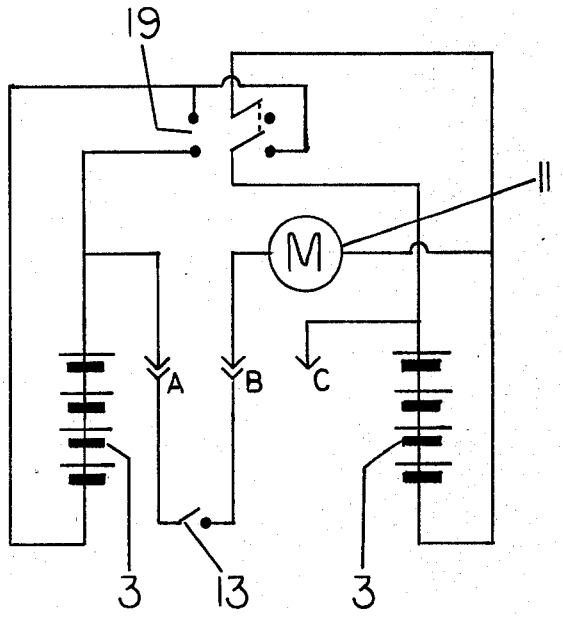
FIG. 6 is a schematic wiring diagram.

In reference to the accompanying drawings tank mount 1 conforms to the curvature of a divers conventional air tank. On either side and welded to the tank mount 1 are the power supply housing 2. Access to the batteries 3 within the power supply housings 2 is accomplished by removing power supply housing covers 4 which is held on by non corrosive screws 5. Between and welded to power supply housings 2 and above and welded to the tank mount 1 is the propeller housing 6. Motor housing supports 7 are welded at one end to the power supply housings 2 and at the other end suspending the motor housing 8 above the center of the tank mount 1 and in line with the center of the propeller housing 6. The propeller 9 is secured to the motor shaft 10 which is a part of the motor 11. The motor housing is sealed from external pressure by shaft seal 12. The control 13 is wired in series with the motor 11 and the batteries 3 through the control cable 14 as shown in the schematic wiring diagram FIG. 6. Switch 19 can be switched to either of two positions with the batteries in parallel giving six volts for slower speed and longer operating time or with batteries in series giving 12 volts for faster speed and shorter operating time. Operating time at the faster speed will exceed 1 hour.

The unit is strapped to the divers air tank by means of straps 15. The control 13 and control cable 14 can be disconnected from the unit at a water tight connector 16. A battery charger can be connected at connecter 16 to recharge the batteries. Shown in the schematic wiring diagram FIG. 6 the control is connected to terminals A and B for operation with terminal C not being used. For charging the batteries the hand control 13 and control cable 14 are disconnected from the unit and a battery charger is connected to terminals A and C with terminal B not being used. A combination inlet, check valve 17 can easily be installed in the housing and connected to the divers air tank pressure regulator and a pressure relief valve 18 to maintain a safe pressure differential between the inside of the unit and outside pressure for use at depths in excess of 200 feet. The fact that this unit is strapped to the divers air tanks leaves the divers hands free to operate a spear gun, camera, tools or any other equipment. The housing of this unit could be manufactured by any one of several different methods such as molded or cast from aluminum or polyvinyl chloride (PVC) plastic, formed and welded sheets of aluminum or PVC plastic, or fabricated from fiber glass. The tank mount designs will vary to conform to the different air tanks and tank arrangements used.

Changes may be made in combination and arrangement of the elements as heretofore set forth in the specifications and shown in the drawings being understood that the changes may be made in the embodiment disclosed without departing from the spirit or scope of the invention as defined in the following claims.

What is claimed is:

1. An improved SCUBA divers propulsion unit strapped to an air tank that is in turn strapped to the SCUBA divers back rather than held in front of said diver; and designed to give said diver freedom of his hands for performing other functions; and to eliminate the necessity of setting said unit aside when use of the hands is required for other functions; the said unit comprising:

a one piece unit housing consisting of:

a tank mount of such shape as to conform to the curvature of said air tank;

two power supply housings symmetrically opposite each other secured to either side of said tank mount;

a propeller housing centered between and secured to said power supply housings and secured at the bottom to said tank mount;

a motor housing centered between and secured to said power supply housings by means of two motor housing supports, one of each of said motor housing supports secured at one end to an opposite side of said motor housing with the other end of each said motor housing supports secured to the center of each of said power supply housings;

a power supply made up of eight one and one half volt cells; four of each said cells mounted in each of the two said power supply housings;

two power supply housing covers, one each of said power supply housing covers secured to the front of each of the said power supply housings by means of non corrosive screws to make a water tight seal to protect said power supply cells;

a motor sealed within said motor housing, powered by said power supply;

a propeller secured to and driven by said motor to provide the required thrust to propel said unit and said diver through the water;

a double pole double throw switch mounted on said power supply housing cover and wired in series with said power supply and said motor having a purpose of supplying either 6 volts or 12 volts to said motor depending on the position of said switch;

a motor control either held in the hand of said diver or clipped to said divers tank harness and wired in series with said motor, said power supply, and said double pole double throw switch to energize said motor when propulsion is desired by said diver;

four straps, one each being attached to each of the four corners of said tank mount with the purpose of securing said propulsion unit to said air tank.

* * * * *